United States Patent [19]

Greier et al.

[11] 4,394,851

[45] Jul. 26, 1983

[54] DECOMPRESSION DEVICE IN AN INTERNAL COMBUSTION ENGINE

[75] Inventors: Josef Greier; Colin T. Pomfret, both of Graz, Austria

[73] Assignee: Hans List, Graz, Austria

[21] Appl. No.: 253,279

[22] Filed: Apr. 13, 1981

[30] Foreign Application Priority Data

Apr. 15, 1980 [AT] Austria ..... 2038/80

[51] Int. Cl.[3] ..... F01L 13/08

[52] U.S. Cl. ..... 123/182; 123/90.16

[58] Field of Search ..... 123/182, 90.16; 417/298

[56] References Cited

U.S. PATENT DOCUMENTS 3,269,375 8/1966 Beal ..... 123/90.16
3,319,619 5/1967 Neuer ..... 123/182
4,184,468 1/1980 Freyn ..... 123/182

FOREIGN PATENT DOCUMENTS 698244 11/1940 Fed. Rep. of Germany .
2019755 7/1973 Fed. Rep. of Germany .
2242206 3/1974 Fed. Rep. of Germany .

*Primary Examiner*—Charles J. Myhre
*Assistant Examiner*—Andrew M. Dolinar
*Attorney, Agent, or Firm*—Watson, Cole, Grindle & Watson

[57] ABSTRACT

A controllable operating spindle includes a decompression cam mounted thereon, which cam is able to keep a valve actuation-movement transmitting element in a position which is spaced away from the position determined by a base circle of a cam on the engine camshaft. A ratchet wheel is connected to the operating spindle which extends along the length of and parallel to the engine camshaft and is adapted to co-act with a trip element for restoring the decompression cam to its original position. The operating spindle includes at least one decompression cam for each cylinder of the engine and between the decompression cam and the valve actuation-movement transmitting element there is provided a decompression lever which influences the transmitting element in accordance with the lift of the decompression cam.

5 Claims, 8 Drawing Figures

DECOMPRESSION DEVICE IN AN INTERNAL COMBUSTION ENGINE

BACKGROUND OF THE INVENTION

The present invention relates to a decompression device in internal combustion engines of the kind comprising a decompression cam or like element mounted on a controllable operating spindle for actuating a valve which is to be influenced by the decompression device. The decompression cam keeps an element, for example, a cam follower, which transmits the operative lift of the camshaft cam to the valve, in a decompression position wherein it is spaced away from the position which is determined by the base circle of the cam on the camshaft of the engine. A ratchet wheel is connected to the operating spindle, which extends along the length of and parallel to the engine camshaft and is adapted to co-act with a trip element for restoring the decompression cam to its original position.

DESCRIPTION OF THE PRIOR ART

A decompression device of the abovementioned kind, which is known from German Laid Out Print No. 2 019 755, is designed for application to the internal combustion engines of the kind in which the valves are actuated by rocker arms. This decompression device comprises a control handle which extends laterally out of the valve chamber. The cam is formed as an eccentric and the hub of one rocker arm is rotatably mounted thereon. The displacement of this rocker arm hub which was mounted on the eccentric is obtained by means of a peripherally toothed driver-plate on which the teeth extend all round the circumference of the plate except for a single tooth gap. Thus it is left to the discretion of the user to decide on the length of the decompression time, and this could occasionally result in maladjustment.

Another form of a decompression device is shown in German Laid Open Print No. 2 242 206. This decompression device is also designed for application in internal combustion engines having valve rocker arms. However, in this arrangement no operting spindle is provided for co-operation with an actuating element, but instead there is provided a friction brake mechanism in the form of two rubber rings which cause a timedelay in the restoration from a decompression to an operative position of the locking element which is applied to the valve mechanism and which prevents the full closing of the valve. This device has a highly complicated construction and also a tendency to malfunction.

Lastly, German Pat. No. 698 244 describes a decompression device for a single-cylinder internal combustion engine in which the exhaust valve is actuated through a pushrod and guiding arm by the cam of the camshaft. The guiding arm is mounted for pivotal movement about a pin which is secured in the housing. A decompression spindle is rotatably mounted parallel to the camshaft and adapted to be rotated by means of a manual control lever which extends out of the valve chamber. The decompression spindle carries a cam and by rotating this cam the exhaust valve can be lifted into a decompression position. Restoration of the exhaust valve is effected by a Maltese-cross transmission system. This known decompression device has the drawback of being virtually unusable in internal combustion engines in which the valves are actuated directly by the camshaft without transmission links or rocker arms, besides which it cannot be used in multi-cylinder engines.

SUMMARY OF THE INVENTION

It is an object of the present invention to eliminate the drawback appertaining to the known devices and to provide a decompression device of the kind specified from the outset which can also be used in internal combustion engines not having rocker arms, which, furthermore, can be fitted in a particularly space-saving manner and which can be re-set very easily or adjusted in case of cam wear. Moreover, the duration or length of time of the decompression process is not to be left to the arbitary choice of the user but instead the decompression device is arranged to be cut out early, after only a few operative cycles whereafter the engine assumes its normal mode of operation.

According to the present invention these aims are achieved primarily due to the fact that the operating spindle comprises at least one decompression cam for each cylinder and that between the decompression cam and the transmission element for valve actuation, for example, the cam follower, there is provided a decompression lever which influences the transmission element in accordance with the lift of the decompression cam.

According to a further development of the present invention the decompression lever is articulately mounted on a vertically adjustable bearing and applied to the decompression cam under spring loading. Due to the vertically adjustable mounting of the decompression lever, which transmits the lift of the decompression cam to the valve-actuation transmission element and thus to the respectively associated valve, it is very easy to adjust the decompression device individually for each cylinder, that is to say for each valve which is to be actuated, and thus compensate for differential amounts of clearance and/or different manufacturing and fitting tolerances. Due to the provision of a spring which maintains the decompression lever constantly applied to the decompression cam, shock loads are very largely avoided in respect of the various component parts of the decompression device and vertical adjustment of the decompression lever is simplified.

If the decompression device—which is also suitable for application in single-cylinder engines—is applied to multi-cylinder internal combustion engines it is particularly advantageous if, in further development of this invention, the operating spindle is provided with intermediate bearings supporting it between the individual cylinders. This prevents undue deflection of the operating spindle which during the decompression process is at least periodically subjected to the full force of the valve spring, and also allows a spindle of smaller diameter to be fitted than would otherwise be necessary.

According to another feature of this invention a ratchet wheel may be arranged in the vicinity of one of the end bearings of the operating spindle. Such an arrangement particularly simplifies the mounting of a pawl which rotates eccentrically with the camshaft. The sudden shock load, which is applied to the spindle by the operative engagement of the pawl with the ratchet wheel on each camshaft revolution for the duration of the decompression process, is transferred in this arrangement to a region which is supported by the bearings of the operating spindle. Moreover, owing to the outer camshaft bearing which is usually provided in the same region there is a relatively large amount of available space for the restoring mechanism of the decompression device which means that the ratchet wheel may be of relatively large dimensions thus reducing wear and increasing useful service life.

According to another feature of the present invention a spring-loaded pin is arranged on one of the spindle bearings which pin engages a recess on the spindle when the latter occupies a position corresponding to commencement of the decompression process. The recess and the pin are designed in such a way that during restoration by the ratchet wheel the pin yields against the spring loading force and becomes non-effective. This provides an end stop for the spindle rotation which initiates the decompression process, thus allowing full utilization of the number of camshaft revolutions executed during the decompression process, which number depends on the number of teeth on the ratchet wheel. Moreover, this arrangement avoids the application of excessive stresses to ratchet wheel and pawl element in as much as it precludes the risk of the pawl element, which revolves with the camshaft, striking against a tooth crest of the ratchet wheel if the latter should happen to be in a non-aligned or intermediate position. This provides a considerable improvement in operational safety of the decompression device.

DESCRIPTION OF THE DRAWINGS

The present invention is hereinafter more particularly described with reference to an embodiment illustrated by way of example in the accompanying drawings, wherein.

DESCRIPTION OF THE PREFERRED EMBODIMENT

Figure 1:
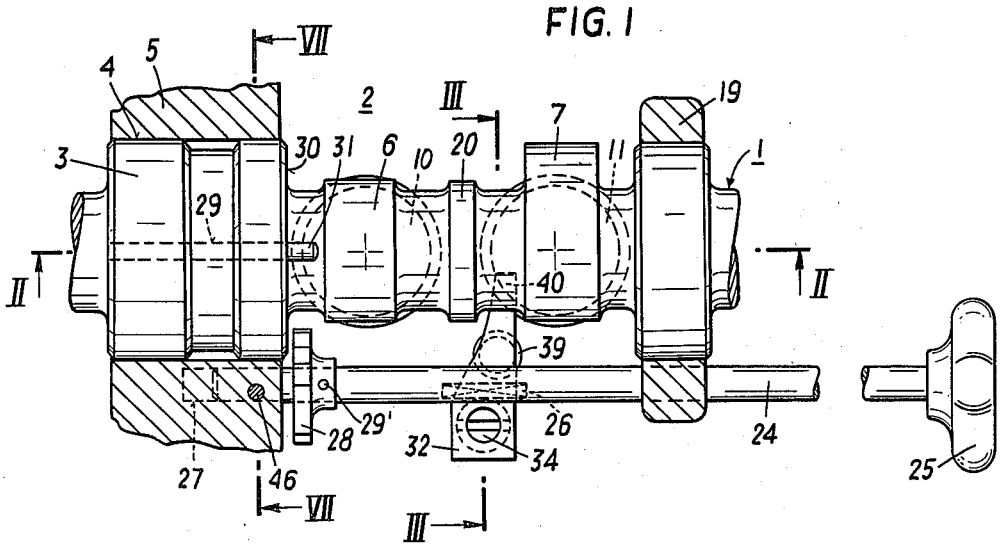
FIG. 1 shows a part-sectional view along line I—I in FIG. 2, of an internal combustion engine fitted with a decompression device according to this invention.

The camshaft 1 of an internal combustion engine (not specifically shown) is arranged in a camshaft chamber 2, and mounted at one end 3 thereof in a journal-bearing in a bore 4 in a wall 5 of the camshaft chamber 2. The camshaft 1 is driven, in a manner not specifically illustrated, by a crankshaft of the internal combustion engine and comprises cams 6 and 7 which in the illustrated embodiment directly actuate two valves 8 and 9 via cam-follower cups 10 and 11. The valves 8 and 9 are guided in bosses 12, 13 of the cylinderhead 14 and, being loaded by the force in valve springs 15, seal off the combustion chamber 16 for as long as the cam follower cups 10, 11 seat on the base circle 18 (FIGS. 3,4) of the cams.

The camshaft 1 is supported by intermediate bearings 19 between the individual cylinders of the engine and is provided, for each cylinder, with a further cam 20 arranged between the cams 6, 7 which actuate the valves 8, 9, which further cam 20 controls a fuel injection pump (not shown). The camshaft chamber 2 is made oiltight relative to the exterior by a cover 21, interposed seal 22 and bolts which are only indicated by their center line 23.

Figure 2:
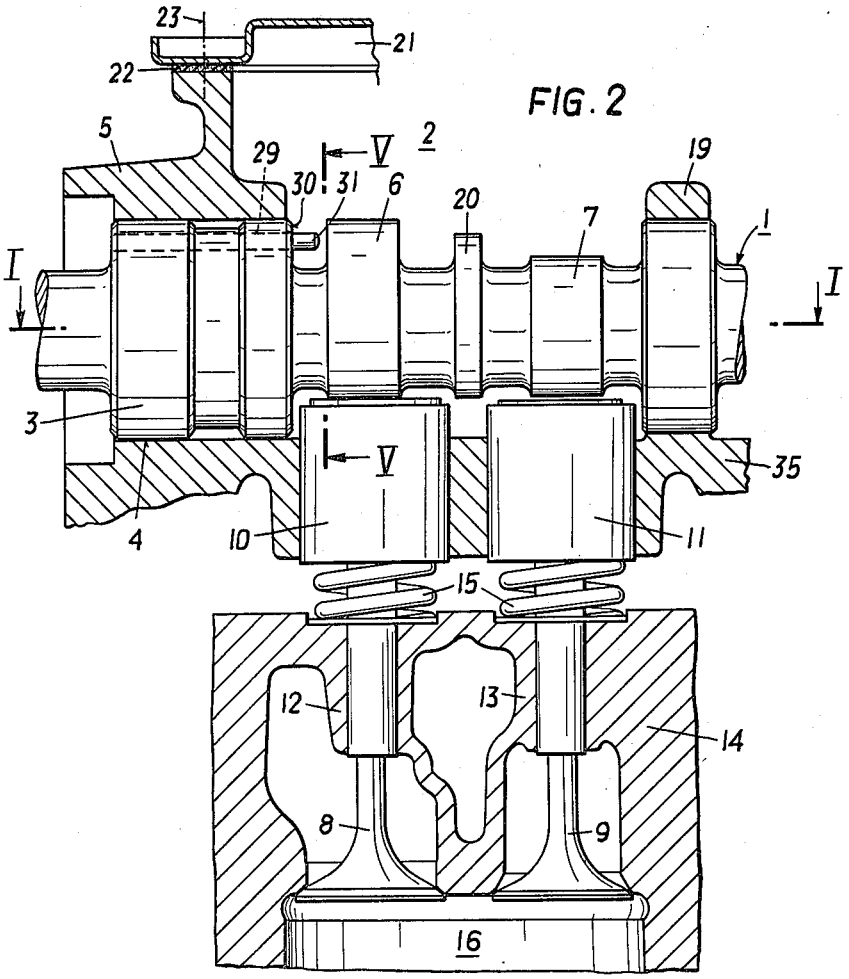
FIG. 2 shows a partial sectional view along line II—II in FIG. 1, FIGS. 3 and 4 show in each case a partial sectional view along line III—III in FIG. 1, but with the decompression device in relatively different operative conditions.
Figure 6:
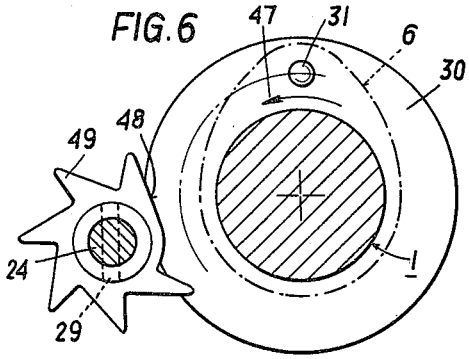

An operating spindle 24, which is adapted to be rotated by a hand wheel 25 mounted thereon externally of the engine case, and which is mounted parallel to the camshaft 1 in the wall 5 of the camshaft chamber 2 and in the intermediate bearings 19 between the individual cylinders, is provided, for each cylinder of the engine or for each valve which is to be actuated by the decompression device, with a decompression cam 26 which is formed by providing a flat face on the cylindrical peripheral surface of the operating spindle 24. Adjacent to an end bearing 27 for the operating spindle 24 a ratchet wheel 28 is secured on the spindle by means of a pin 29'. The ratchet wheel 28 co-acts with a trip pin 31 arranged in a bore 29 formed in end 3 of the camshaft 1 and which protrudes from a shoulder 30 of the camshaft. This trip pin 31 revolves eccentrically with the camshaft 1 and, as will be seen from FIGS. 2 and 6, is so arranged in the shoulder 30 that, as viewed in the direction of the camshaft axis, it is within the contour of cam 6 so that, despite the very compact and close assembly, the trip pin 31 cannot strike against the cam follower cup 10.

In the range of the decompression cam 26, that is to say, in the region of the valve 9 which is to be actuated by the decompression device, there is a decompression lever 32 which transmits the lift of decompression cam 26 to the cam follower cup 11 which actuates valve 9. That end of the decompression lever 32 which is opposite the cam follower 11 is provided with a bore 33 by which it sits on a fillister-head screw 34. This screw 34 is screwed into a threaded hole in the bottom base 35 of the camshaft chamber 2 and made resistant to rotation by a plastic pin 36 inserted in its threaded shank and bearing against the threaded bore. Thus a vertically adjustable support is provided for the articulated mounting of the decompression lever 32. On the opposite end to the bore 33 in relation to the operating spindle 24, the decompression lever 32 is provided with a nodule 37 which centers a spring 39 fitted in a bore 38 in the base 35 of the camshaft chamber 2. This spring 39 applies the decompression lever 32 to the decompression cam 26 on operating spindle 24 and to the bearing surface provided by the fillister-head screw 34 and thus prevents relative play between these parts. The end 40 of the decompression lever 32 which is opposite the bore 33 is adapted to co-act with the cam follower cup 11.

Figure 3:
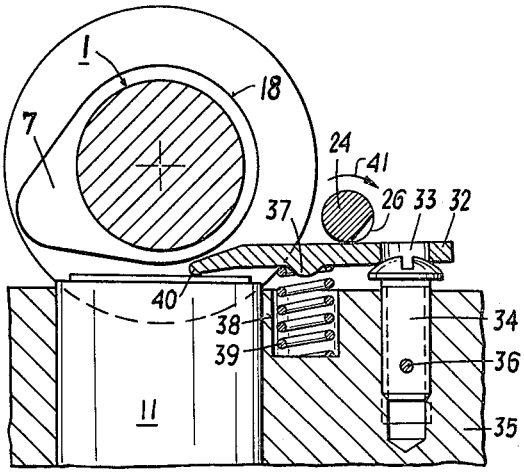
Figure 4:
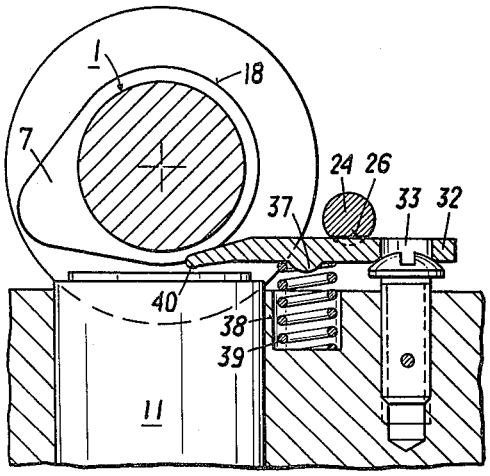
Figure 5:
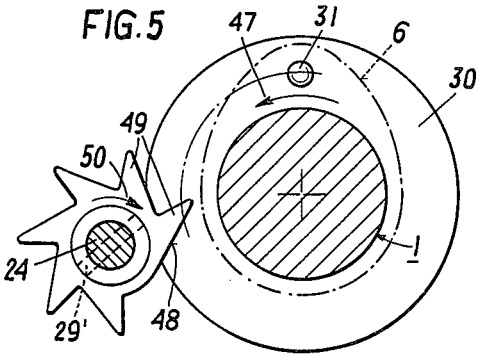
FIGS. 5 and 6 show partial sectional views along line V—V in FIG. 2 of the device in the operative conditions respectively corresponding to FIGS. 3 and 4, and FIGS. 7 and 8 show partial sectional views along line VII—VII in FIG. 1, again reflecting operative conditions respectively corresponding to FIGS. 3 and 4.
Figure 7:
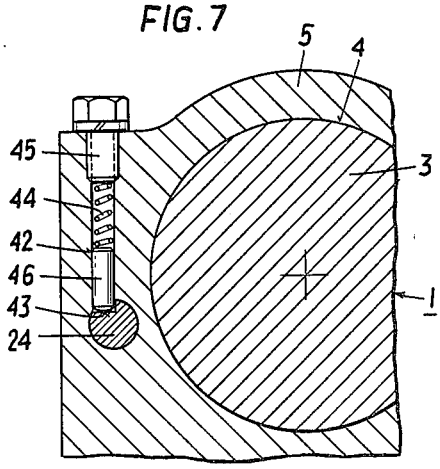
Figure 8:
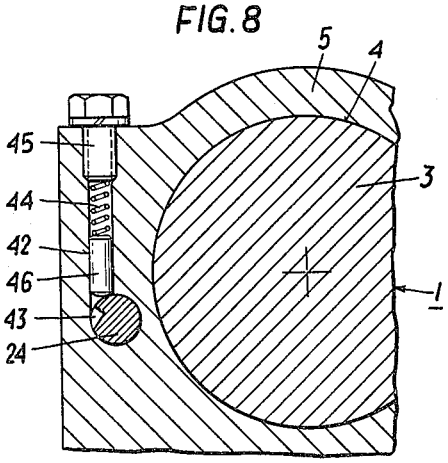

The mode of operation of the decompression device according to this invention is more particularly described as follows. FIGS. 4, 6 and 8 show the device in the disengaged position, that is to say when the engine has been stopped or when it has been running for some time, and FIGS. 3, 5 and 7 show the device at the point when the decompression process has just begun.

To initiate decompression with the engine stationary, the operating spindle 24 is turned by handwheel 25 in the direction of arrow 41 (FIG. 3) so that the flat face of the decompression cam 26 on the spindle 24 is disengaged from the decompression lever 32 and the latter, under the opposing force produced by the cylindrical surface of the cam 26 displaces the cam follower 11 against the force of the spring 39 in the direction of opening the associated valve 9 by a distance which is determined by the lift of the decompression cam 26. This initial rotation of the spindle 24 is limited by a stop arranged on end bearing 27 whereby the initial operative condition of the decompression device is established which is represented in FIGS. 3, 5 and 7. According to FIG. 7 the stop for the operating spindle 24 is provided by a pin 46 guided in a bore 42 of end bearing 27 and engaging a recess 43 formed in the circumferential surface of the operating spindle. The pin 46 is loaded by a spring 44 which is also contained in the bore 42 and pretensioned by a screw 45. The recess 43 in the spindle 24 and the pin 46 are so designed that the pin 46 moves against the action of spring 44 during the restoration of the spindle by means of the ratchet wheel 28 subsequently described.

The end 40 of decompression lever 32, now depressed by the cylindrical part of the decompression cam 26, has lifted the cam follower cup 11 away from the position which is determined by the base circle 18 of cam 7 on camshaft 1, so that the associated valve 9 can no longer close completely and normal compression is prevented in the combustion space 16. In the position of ratchet wheel 28 shown in FIG. 6, when the operating spindle 24 occupies the position shown in FIG. 4, a tooth gap 48 allows unobstructed rotation of the trip pin 31 mounted in shoulder 30 of camshaft 1. When the spindle 24 is turned into the position represented in FIG. 3 the position of the ratchet wheel 28 changes to that shown in FIG. 5.

During the starting up of the internal combustion engine which is assisted by the actuation of the decompression device, each revolution of camshaft 1 in the direction of arrow 47 (FIG. 5) brings the trip pin 31 successively into engagement with one of the teeth 49 of the ratchet wheel 28. Thus the operating spindle 24 and hence the decompression cam 26 are turned back on each revolution of camshaft 1 in the direction of arrow 50 through an angle which depends on the tooth pitch of the ratchet wheel 28, until the tooth gap 48 once more allows unobstructed rotation of the trip pin 31. At this point the decompression process is completed, which means in particular that the cam follower 11 drops back onto the base circle 18 of cam 7 and the condition which is depicted in FIGS. 4, 6 and 8 has been restored. In the illustrated embodiment the decompression process is thus completed after six camshaft revolutions which is perfectly adequate for easy starting of the engine.

Adjustment of the decompression device for each individual cylinder, which is particularly important in multi-cylinder engines can be very easily obtained by means of the fillister-head screw 34 which supports the decompression lever 32, namely by adjusting the screw 34 to such a height that the end 40 of lever 32 does not prevent the complete closure of the associated valve 9 in normal engine operation whilst on the other hand there is no significant play between the lever end 40 and the cam follower 11 which could impair the effect of the decompression cam.

The arrangement according to this invention which, as has been hereinbefore described in respect of the illustrated embodiment, affords special advantages in its application to multi-cylinder internal combustion engines is however equally well adapted for application to single-cylinder engines, a special advantage arising from the fact that for the correct functioning of the device according to this invention it is quite immaterial what type of valve actuation mechanism may be provided in the engine.

We claim:

1. A decompression device for an internal combustion engine having at least one cylinder, at least one valve, and a camshaft including at least one cam having a base circle cam surface, said decompression device comprising:

a controllable operating spindle mounted on said engine and extending along the length of and parallel to said camshaft;

at least one decompression cam disposed on said operating spindle and provided for each said at least one cylinder;

a follower element for transmitting an operative lift of said camshaft cam to said valve;

a ratchet wheel connected to said spindle;

a trip element coacting with said ratchet wheel for restoring said decompression cam to an original position;

a decompression lever having one end for contacting said follower element and being articulately disposed between said decompression cam and said follower element;

a vertically adjustable bearing contacting the other end of said decompression lever; and spring means for articulately mounting said decompression lever on said adjustable bearing and for applying said decompression lever to said decompression cam under spring loading, said at least one decompression cam being controllable to cause said decompression lever to selectively maintain said follower element in a decompression position with said follower element being spaced apart from said base circle cam surface.

2. A decompression device as claimed in claim 1 for a multi-cylinder internal combustion engine, further comprising a plurality of bearings wherein at least one bearing is disposed between cylinders for supporting said operating spindle.

3. A decompression device as claimed in claim 2 further comprising:

a spring biassed pin disposed within one of said bearings for supporting said operating spindle, said operating spindle further comprising a recess formed therein for engagement with said spring biassed pin upon said spindle being placed in a position corresponding to commencement of decompression such that said spring biassed pin yields during restoration of said operating spindle to a predetermined original position via rotation of said ratchet wheel.

4. A decompression device as claimed in claim 1 further comprising an end bearing for supporting said operating spindle, and said ratchet wheel being disposed adjacent said end bearing.

5. A decompression device as claimed in claim 4 further comprising:

a spring biassed pin disposed within said end bearing; and said spindle further comprising a recess formed therein for engagement with said spring biassed pin upon said spindle being placed in a position corresponding to commencement of decompression such that said spring biassed pin yields during restoration of said operating spindle to a predetermined original position via rotation of said ratchet wheel.

* * * * *